US009783942B1

(12) United States Patent
Stell et al.

(10) Patent No.: US 9,783,942 B1
(45) Date of Patent: Oct. 10, 2017

(54) GUTTER BROOM POSITION-CONTROL SYSTEM

(71) Applicants: Edward B. Stell, New Market, AL (US); Dale D. Glubrecht, Madison, AL (US)

(72) Inventors: Edward B. Stell, New Market, AL (US); Dale D. Glubrecht, Madison, AL (US)

(73) Assignee: Schwarze Industries, Inc., Huntsville, AL (US)

( * ) Notice: Subject to any disclaimer, the term of this patent is extended or adjusted under 35 U.S.C. 154(b) by 767 days.

(21) Appl. No.: 14/252,637

(22) Filed: Apr. 14, 2014

Related U.S. Application Data

(60) Provisional application No. 61/811,797, filed on Apr. 14, 2013.

(51) Int. Cl.
*E01H 1/05* (2006.01)
*E01H 1/04* (2006.01)
*E01H 1/08* (2006.01)

(52) U.S. Cl.
CPC ..... *E01H 1/056* (2013.01); *E01H 1/04* (2013.01); *E01H 1/05* (2013.01); *E01H 2001/0881* (2013.01)

(58) Field of Classification Search
CPC ..... E01H 1/05; E01H 1/08; E01H 2001/0881; E01H 1/056
USPC ..... 15/82, 87, 340.3
See application file for complete search history.

(56) References Cited

U.S. PATENT DOCUMENTS 3,886,623 A * 6/1975 Landesman ..... E01H 1/053 15/319
3,886,624 A * 6/1975 Landesman ..... E01H 1/053 15/340.3
4,160,302 A * 7/1979 Hirst ..... E01H 1/0845 15/340.3
4,218,798 A * 8/1980 Block ..... A47L 11/16 15/49.1
4,335,482 A * 6/1982 Jones ..... E01H 1/053 15/87
4,368,554 A * 1/1983 Mealing ..... E01H 1/047 15/340.3
4,691,402 A * 9/1987 Veselka ..... E01H 1/053 15/87
4,754,521 A * 7/1988 Zoni ..... E01H 1/042 15/340.1
5,173,989 A * 12/1992 Young ..... E01H 1/0863 15/340.1

(Continued)

*Primary Examiner* — Michael Jennings
(74) *Attorney, Agent, or Firm* — Wallace G. Walter

(57) ABSTRACT

A roadway sweeper (10) is provided with a pneumatic 'lift' cylinder (LC) connected through linkages to a gutter broom (12) and is pressurized at a operator-selected one of a plurality of air pressures to control the force the gutter broom (12) applies to the surface being swept. In a similar manner, a pneumatic 'swing-out' cylinder (PC) that is also pressurized at one of a plurality of operator-selected air pressures to cause the gutter broom (12) to 'swing-out' from a fully retracted position toward its fully extended position. A spring element (S), such as one or more helical springs, is connected in parallel with the swing-out cylinder (PC) so that the gutter broom (12) is positioned reliably and repeatedly in response to a user-selected one of many pressure states $P_n$.

9 Claims, 6 Drawing Sheets

(56) References Cited

U.S. PATENT DOCUMENTS

| | | | | | |
|---|---|---|---|---|---|
| 5,881,417 | A * | 3/1999 | Knowlton | A47L 11/24 | 15/340.4 |
| 6,000,084 | A * | 12/1999 | Briscoe | A47L 11/14 | 15/49.1 |
| 6,618,897 | B2 * | 9/2003 | Lewis | A46B 13/001 | 15/319 |
| 6,675,424 | B2 * | 1/2004 | Smith | E01H 1/047 | 15/340.4 |
| 6,854,157 | B2 * | 2/2005 | Strauser | E01H 1/053 | 15/340.4 |
| 7,765,630 | B2 * | 8/2010 | Flora | A01D 51/002 | 15/340.1 |
| 8,136,193 | B2 * | 3/2012 | Larkowski | E01H 1/053 | 15/340.3 |
| 8,430,178 | B2 * | 4/2013 | McCurdy | A01D 34/74 | 172/59 |
| 8,769,755 | B2 * | 7/2014 | Hetler | E01H 1/053 | 15/49.1 |
| 9,045,872 | B2 * | 6/2015 | Wahl | E01H 1/053 | |
| 9,249,547 | B2 * | 2/2016 | Du Maire | E01H 1/053 | |
| 2004/0020003 | A1 * | 2/2004 | Strauser | E01H 1/053 | 15/340.3 |
| 2004/0068825 | A1 * | 4/2004 | Fields | A47L 11/24 | 15/340.4 |
| 2010/0325824 | A1 * | 12/2010 | Baum | A01K 1/01 | 15/87 |
| 2015/0007411 | A1 * | 1/2015 | Vanderlinden | E01H 1/0854 | 15/383 |

* cited by examiner

GUTTER BROOM POSITION-CONTROL SYSTEM

CROSS-REFERENCE TO RELATED APPLICATION

This patent application claims the benefit of commonly owned U.S. Provisional Patent Application 61/811,797 filed Apr. 14, 2013 filed by the inventors herein, the disclosure of which is incorporated herein by reference.

BACKGROUND

The present invention relates to mechanized sweeper vehicles that carry one or more gutter broom assemblies each having a rotatable gutter broom for sweeping debris from a pavement toward a pick-up head (in a vacuum or regenerative sweeper) or toward a primary broom (in a mechanized broom sweeper) to sweep debris from pavements and roadways and, more particularly, to a gutter broom positioning-system for reliably and repeatedly positioning a gutter broom at anyone of a plurality of operator selectable positions.

Pavement sweepers of the type used to sweep municipal streets typically include rotatable circular side brooms that are designed to engage the roadway or pavement at the intersection of the pavement and the curbstone, i.e., the gutter. The sweepers typically include a gutter broom mounted on each side of the vehicle; the brooms are motor-driven to brush any accumulated dust/debris into the path of a primary vacuum intake hood, in the case of vacuum regenerative sweepers, or into the path of a primary brush, in the case of mechanized broom sweepers, to move the debris into a containment bin or hopper.

FIG. 1 presents a top view of a generic sweeper vehicle 10 travelling in the direction indicated by the arrow 10-1. The vehicle 10 is equipped with two gutter brooms 12-1 and 12-2 which extend from the underside of the chassis. In FIG. 1, the broken vertical lines $P_1$, $P_2$, and $P_3$, on the driver side of the vehicle 10 are representative of a plurality of possible positions $P_n$ that the gutter broom 12-1 can extend to laterally from the driver side of the vehicle 10. In a similar manner, the broken vertical lines $P_1$, $P_2$, and $P_3$, on the passenger side of the vehicle 10 are also representative of a plurality of possible positions $P_n$ that the gutter broom 12-2 can extend to laterally from the passenger side of the vehicle 10. The three positions shown in FIG. 1, $P_1$, $P_2$, and $P_3$, are merely representative of a much larger number of possible positions $P_n$. In FIG. 1, the gutter brooms 12-1 and 12-2 are shown at different positions to indicate independent control of each gutter broom; in practice, a sweeper vehicle 10 will generally use only one gutter broom at a time to sweep a single gutter.

It is desirable to have a measure of repeatability in extending a gutter broom to a specific position to optimize the sweeping efficiency for a particular gutter; in general, the vehicle operator will use in-cab controls to extend a gutter broom with the operating position based on operator skill. An attempt, has been made to automate gutter broom positioning to allow more precision in the process, as presented in U.S. Pat. No. 8,136,193 issued Mar. 20, 2012 and assigned to Federal Signal Corp. in the '193 patent, various sensors detect the broom position angle and other angular values and store those values in a memory. Thus, the operator can recall a particular set of data from the memory and set a gutter broom to those values. The system presented in the '193 is relatively expensive and is vulnerable, as are all sensor-dependent control-systems in harsh environments, to sensor reliability and repeatability issues.

SUMMARY

A pavement or roadway sweeper is provided with at least one gutter broom mounted on support structure that allows for movement of the gutter broom to and from a lifted position and a pavement surface-engagement position and also allows for a swing-out movement of the gutter groom between in a range of positions, between a fully retracted position and a fully extended position.

A pneumatic 'lift' cylinder is connected through linkage to the rotatable broom and connects to an in-cab controller that allows the operator to supply pressurized air to the cylinder at one of many operator-selectable pressure settings. When the lift cylinder is unpressurized, the weight of the gutter broom causes the broom to contact the pavement with maximum applied force; when the lift cylinder is fully pressurized, the gutter broom is fully lifted from roadway. Application of one the many pressure states between unpressurized and fully pressurized allows the operator to exercise relatively fine control of the force that the gutter broom applies to the surface being swept. Because pressurized air is compressible (in contrast to a hydraulic fluid), the pneumatic cylinder possesses a measure of compliance as the gutter broom rides along uneven surface as they are being swept.

A pneumatic 'swing-out' cylinder is connected to that portion of the support structure that allows the gutter broom to 'swing-out' from a fully retracted position toward its fully extended position. A spring member, such as one or more helical springs, is connected with the swing-out cylinder so that the swing-out cylinder is working against the tension force of the tensioned spring member as the gutter broom is moved throughout its range of motion toward its fully extended position. The gutter broom swing-out position is reliably and repeated controlled by selecting a one of many air pressure states. Thus, for a first air pressure point, the gutter broom will swing-out to a position corresponding to first physical position ($P_1$), for a second air pressure point, the gutter broom will swing-out to a position corresponding to second physical position ($P_2$), and for a third air pressure point, the gutter broom will swing-out to a position corresponding to a third physical position ($P_3$). In general, for each of n discrete air pressure values available, a corresponding number of physical swing-out positions $P_n$ can be repeatedly and reliably selected by vehicle operator. Application of one the many pressure states between unpressurized and fully pressurized allows the operator to exercise relatively fine control of the position that the gutter broom assumes as the gutter is being swept.

The present invention achieves cost-efficient repeatability and reliability functionality relative to systems that utilizes sophisticated controls systems.

DESCRIPTION

Figure 1:
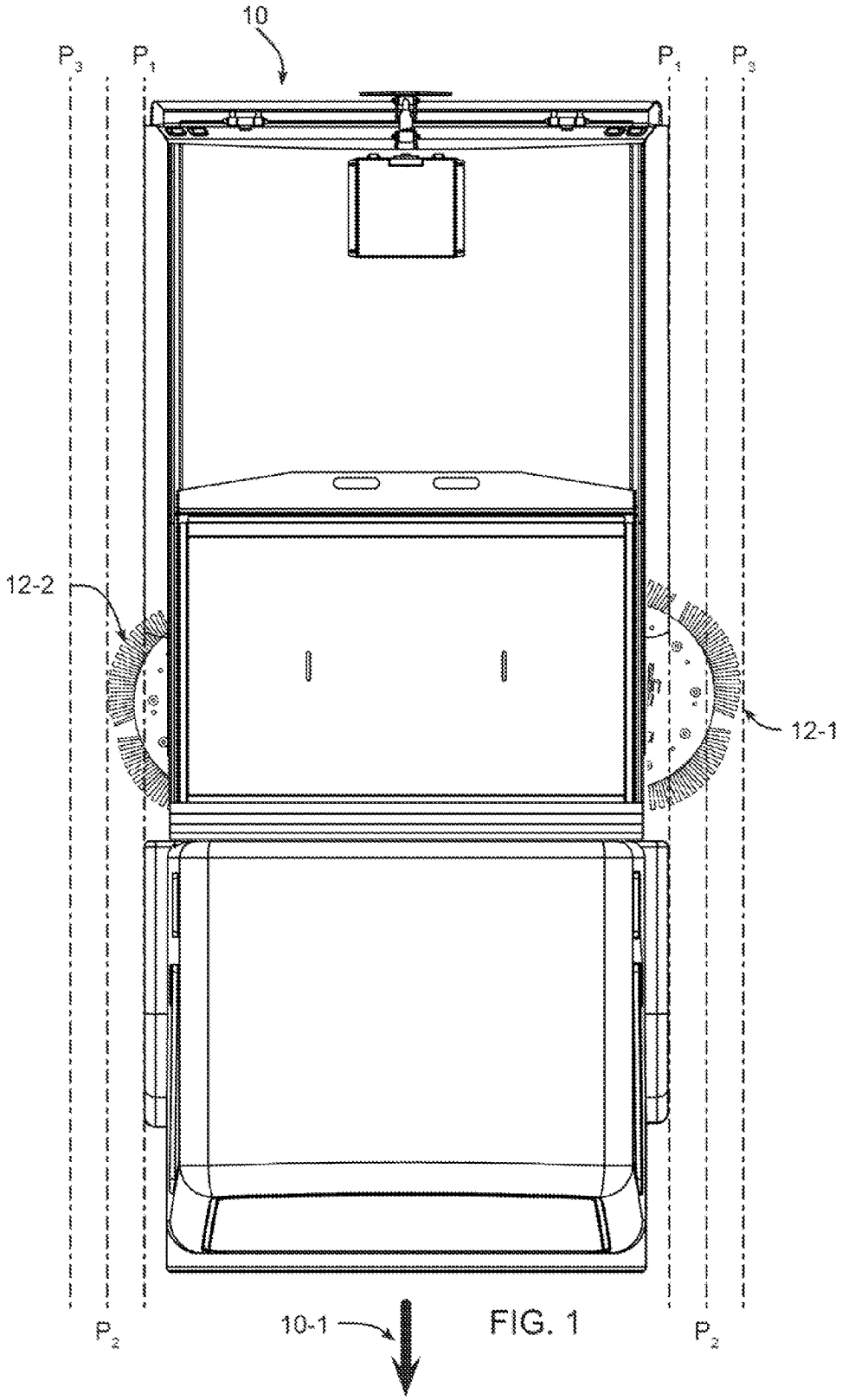
FIG. 1 is a top view of a exemplary pavement or roadway sweeper having laterally mounted gutter brooms.

As shown in FIGS. 2-5, an example gutter broom assembly includes a conventional gutter broom 12 fabricated from a generally circular disc structure 14 having a plurality of bristle segments secured thereto by threaded fasteners (unnumbered). A hydraulic motor 16, carried in a housing 18, is mounted in the central part of the disc structure 14 and rotates the broom 12 to sweep dust and debris from the roadway or pavement. The gutter broom assembly is connected to the underside or chassis of the vehicle 10 by a mounting structure, generally shown at 20, which is specific to each type of vehicle.

A pneumatic 'lift' cylinder LC is connected between the motor housing 18 and a cylinder mount, and, depending upon the air pressure supplied to the rod end of the lift cylinder LC, functions to reduce the force applied by the brush 12 to the roadway or, if desired, lift the brush 12 to and toward an upper retracted position. The lift cylinder LC operates in cooperation with a four-bar linkage, as described below, to maintain the brush 12 at a preferred attitude relative to the surface of the roadway as it is lifted from the roadway, as indicated by the bidirectional arrow in FIG. 4.

A pneumatic position-control cylinder PC is also connected between the motor housing 18 and a cylinder mount, and, depending upon the air pressure supplied to the base end of the position-control cylinder PC, functions to control the outboard extension or position of the broom 12 (as represented by positions $P_1$, $P_2$, and $P_3$ shown in FIG. 1) by controlled rotation of the broom assembly about a pivot axis $A_x$, (FIGS. 6, 8, and 9) as described more fully below and as indicated by the bidirectional arrow in FIG. 8.

Figure 2:
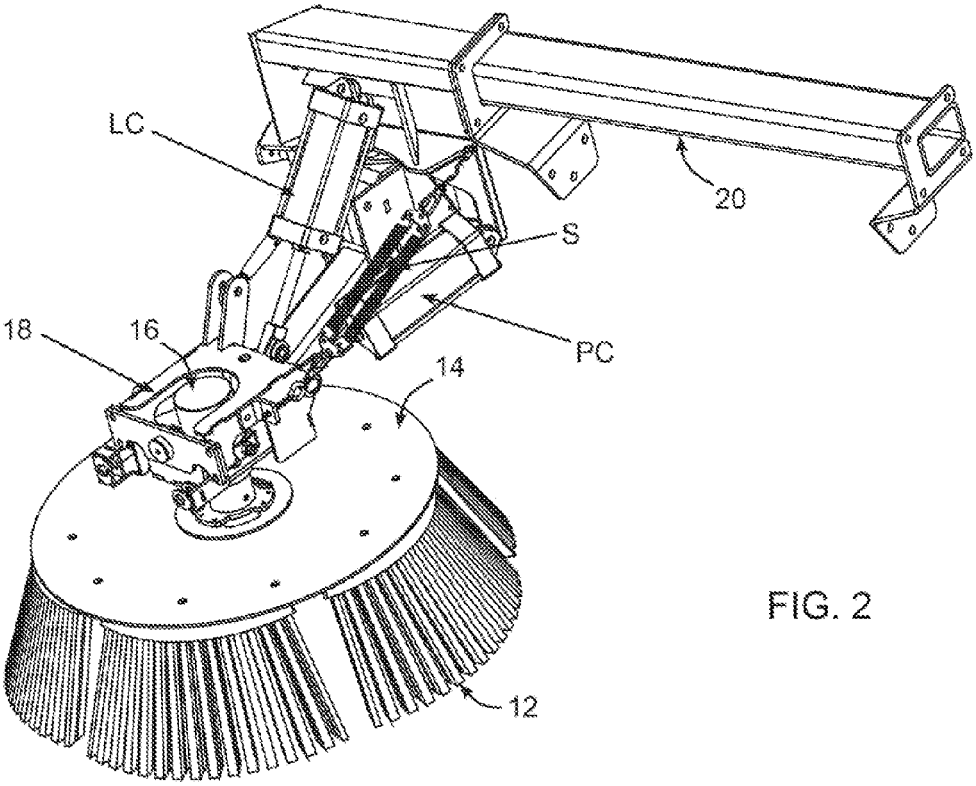
FIG. 2 is a perspective view of a gutter broom assembly.
Figure 3:
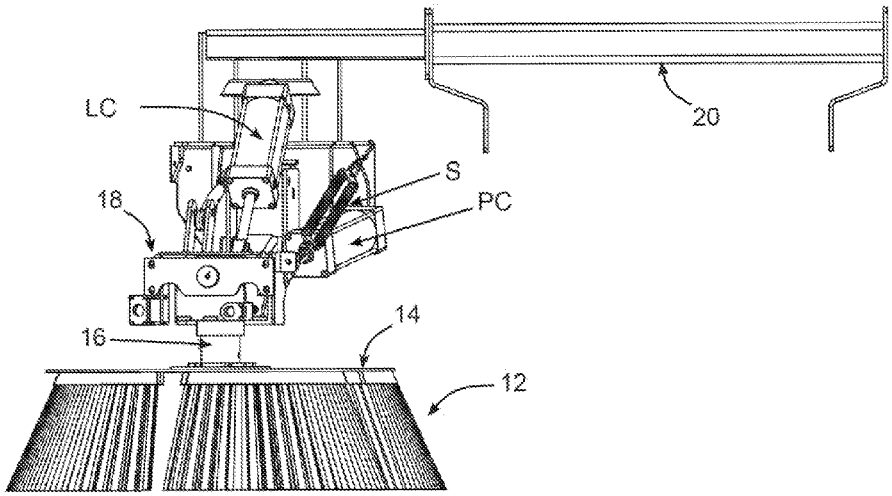
FIG. 3 is an elevation view of the gutter broom assembly shown in FIG. 2.
Figure 5:
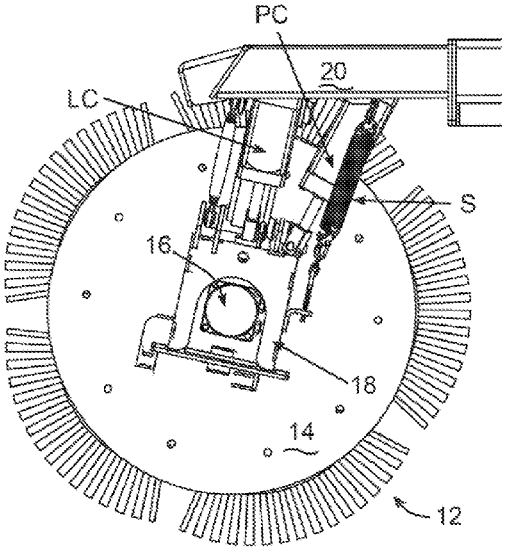
FIG. 5 is top view of the gutter broom assembly shown in FIG. 3.

As shown in FIGS. 2, 3, and 5, a spring assembly S is connected in relationship to the position-control cylinder PC to forcibly oppose the extension of the rod end of the position-control cylinder PC. In the disclosed embodiment, the spring assembly S includes a first and second helical springs both connected to a bracket near the base end of the position-control cylinder PC and, at the opposite end thereof, to the motor housing 18. While two 'parallel-connected' springs are shown in the disclosed embodiment, a single helical spring can be used and, if desired, more that two springs can be used. The connection points between the spring assembly S and the motor housing 18 and the support structure 20 shown in the figures is exemplary and other connections points are just as suitable; thus, the one end of the spring assembly can be connected, directly or indirectly, to the rod end of the position-control cylinder PC and the other end connected, directly or indirectly, to the base end of the position-control cylinder PC.

Figure 10:
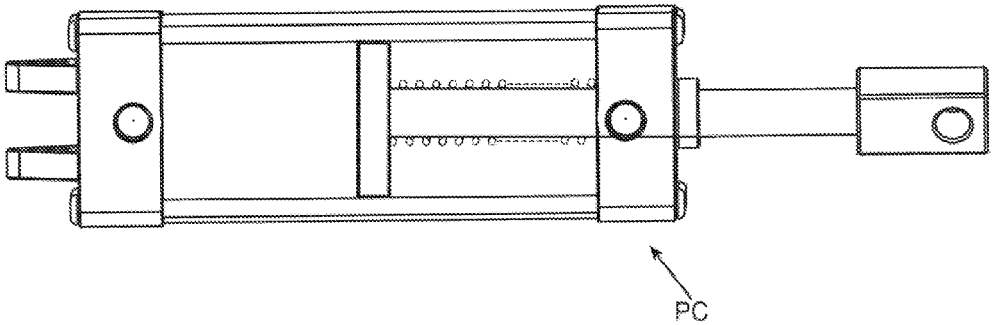
FIG. 10 is an example of one alternate spring arrangement.

The spring assembly 5, when tensioned, functions to apply a force to the position-control cylinder PC that resists or works against the rod of position-control cylinder PC from extending, as explained more fully below. While helical springs are shown, other types of springs are suitable, provided an increasing counterforce is applied against the rod end of the position-control cylinder PC as the rod of the position-control cylinder PC is extended in response to increasing air pressure in the position-control cylinder PC. In the embodiment shown, the spring assembly is stretched in tension when as the rod of the position-control cylinder PC is extended with that tension force seeking to pull the rod end toward the base end of the cylinder against the force provided by the pressurized air in the position-control cylinder PC. If desired, a spring (or springs) in compression can accomplish the same function, for example, a specially fabricated position-control cylinder PC can include a helical spring internal to the cylinder and surrounding the rod between the internal piston and the end of the cylinder, as represented in a simplified manner in FIG. 10. Thus, as the piston is forced by the pressurized air toward its extended position, the helical spring, now in compression, seeks to push the piston (and the attached rod) toward the base end of the cylinder against the force provided by the pressurized air in the position-control cylinder PC until an equilibrium position is attained.

Figure 2A:
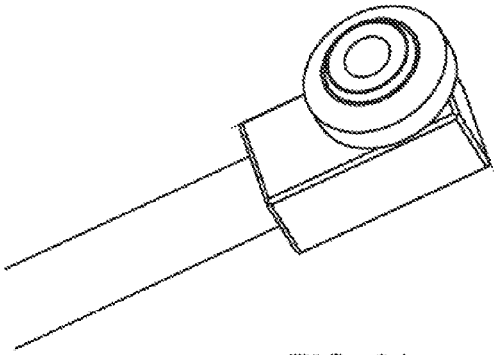
FIG. 2A illustrates a representative spherical rod end.
Figure 4:
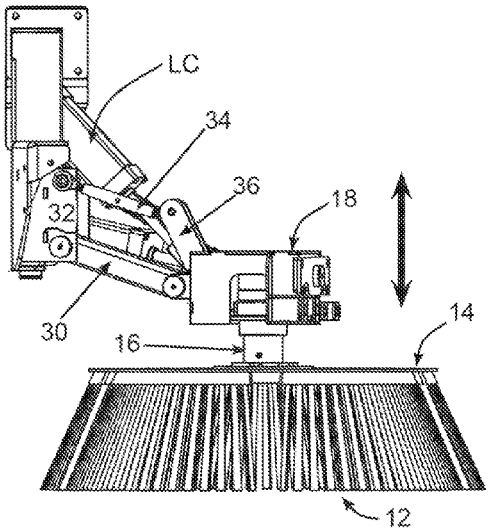
FIG. 4 is side elevational view the gutter broom assembly shown in FIG. 3.
Figure 6:
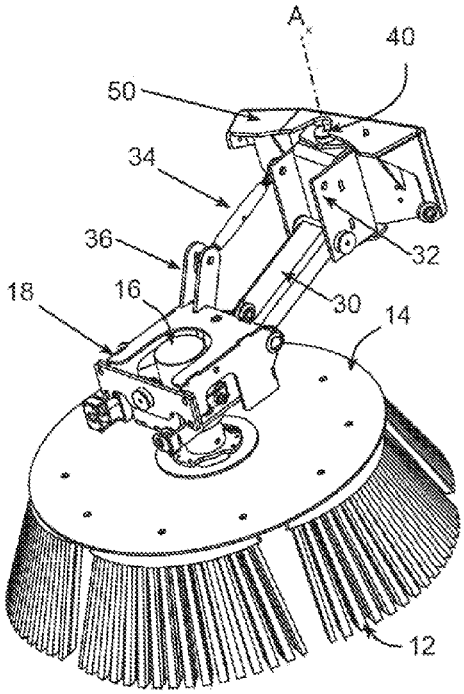
FIG. 6 is a perspective view of the gutter broom with selected parts removed for reasons of clarity.
Figure 7:
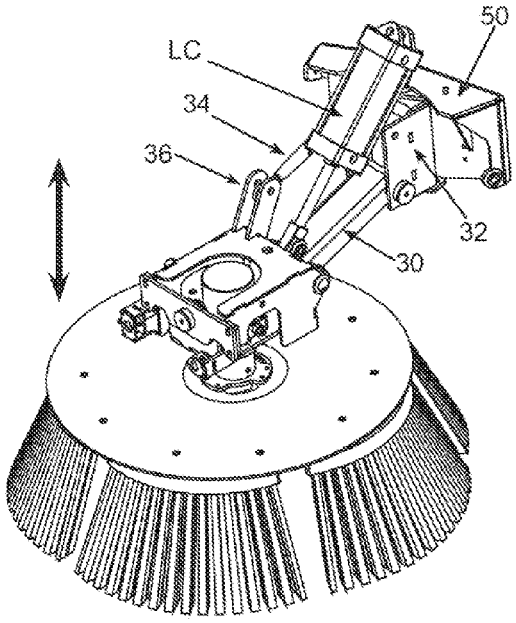
FIG. 7 is the same a FIG. 6 but a pneumatic lift cylinder added.

The gutter broom 12, its motor 16, and the motor housing 18 are connected to the mounting structure 20 through the equivalent of a four-bar linkage. As best shown in FIGS. 4, 6, and 7, a lower control arm 30 is connected at one end through a bearing shaft (unnumbered) to the motor housing 18 and, at the other end, to a bearing shaft (unnumbered) to a bracket 32. An adjustable turnbuckle 34 is connected, at one end, to the motor housing 18 through a bracket 36 and, at the other end, to the bracket 32. The turnbuckle 34 connects via spherical rod ends at both ends thereof (a representative spherical rod end is shown in FIG. 2A).

In the disclosed design, the rod end of the lift cylinder LC is connected to the motor housing 18 through a spherical rod end and, in a similar manner, the base end of the lift cylinder LC also connects through a spherical end connector. The lift cylinder LC functions to both lift the gutter broom 12 from its on-the-roadway position to its fully lifted position and to also control the force applied by the broom bristles to the surface being sweep. More specifically, the base end of the lift cylinder LC is vented to the ambient atmosphere (through appropriate filters) and pressurized air, at values selected by the vehicle operator (as discussed below in relationship to FIG. 10), is introduced into the rod end of the lift cylinder LC. When no or very little pressurized air is provided to the rod end of the lift cylinder LC, the gutter broom 12 lowers to the roadway surface under its own weight, this operational state representing the maximum available downward brushing force. In general, the internal friction of the lift cylinder LC functions as a damping function to prevent the gutter broom 12 from falling in an unconstrained manner to the roadway surface. If a lower brushing force is desired, pressurized air at one of a plurality of operator-selected air pressure values is admitted to the rod end of lift cylinder LC to act against the weight of the gutter broom 12 and thereby lower the brushing force. In general, air pressure values of between 10 and 100 psi are considered appropriate for the disclosed embodiment; since air is compressible, the system is compliant (in contrast to pressurized hydraulic fluid) consequent to forced movement of the lift cylinder LC rod caused by the gutter broom 12 riding over uneven or undulating roadway surfaces.

In the disclosed embodiment, the rod end of the lift cylinder LC is connected to the motor housing 18 and the base end thereof to bracket structure that connects to the vehicle frame or chassis, both ends being connected through spherical end connectors. If desired, it is possible to reverse the lift cylinder LC so that base end connects to the motor housing 18 and the rod end connects to the vehicle underside or chassis through one or more brackets. In this case, the rod end of the so-reversed lift cylinder LC is vented (through an appropriate air filter) and the pressurized air applied via the base end of the lift cylinder LC.

Figure 8:
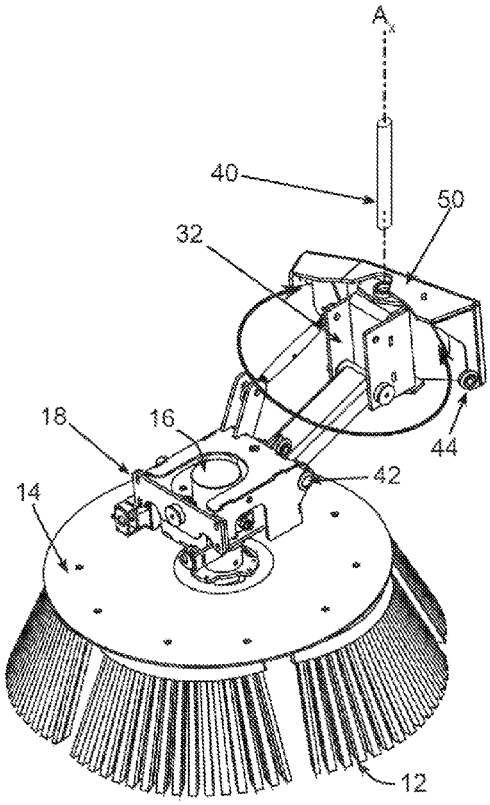
FIG. 8 is a perspective view of the gutter broom with selected parts removed for reasons of clarity.

As shown in FIG. 8, the bracket 32 is mounted for pivoting motion about generally vertical axis $A_x$ through a pivot shaft 40 and bushing arrangement; thus, the gutter broom 12 and its connected linkages can rotate about the shaft 40 through a range of motion between a position in which the gutter broom 12 is considered to be in a 'stowed' or retracted position through to a maximum fully extended or 'deployed' position. As shown in FIG. 1 and as discussed above, the gutter broom 12 can be reliably and repeatedly positioned at one of many possible intermediate positions $P_n$ by the vehicle operator.

Figure 9:
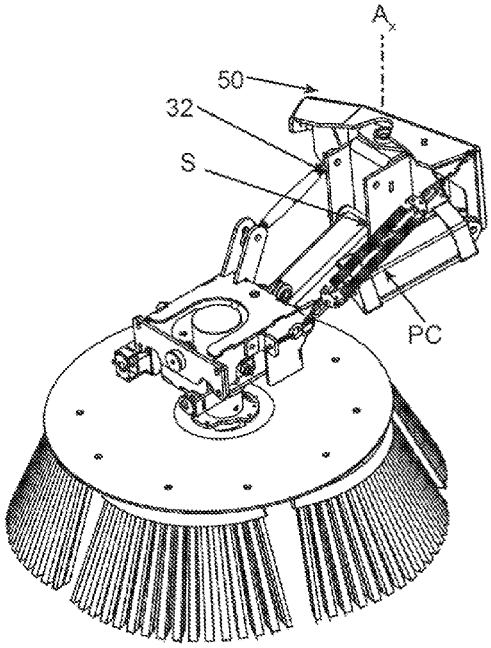
FIG. 9 is the same a FIG. 8 but with a pneumatic swing cylinder added.

As shown in FIG. 9, the position-control cylinder PC is connected at its rod end via a spherical end connector to the motor housing 18 and, at its base end, to a bracket 50 that connects via the mounting structure 20 to the vehicle underside or chassis; the base end of the position-control cylinder PC is not connected to the rotatably mounted bracket 32 that is rotatable about axis $A_x$. Additionally, the spring element S is likewise connected between the motor housing 18 and the bracket 50. Since the position-control cylinder PC is pressurized with air and air is compressible, the rod end of the position-control cylinder PC will work against the tensioned spring elements S and extend until some equilibrium state is achieved, viz., the spring element S is stretched and thereby tensioned so that its in-tension force is equal to the outward force of the air-pressurized position-control cylinder PC. With each successive increment or decrement in air pressure, the rod end of the position-control cylinder PC will extend or retract a corresponding amount. In general, for successive increments of air pressure successive increments in the swing-out position of the gutter broom 12 are determined. For example, assuming six discrete positions are desired, six discrete air pressure values can be empirically determined. Likewise, for n possible swing-out positions, n corresponding air pressure values can be readily empirically determined.

Figure 11:
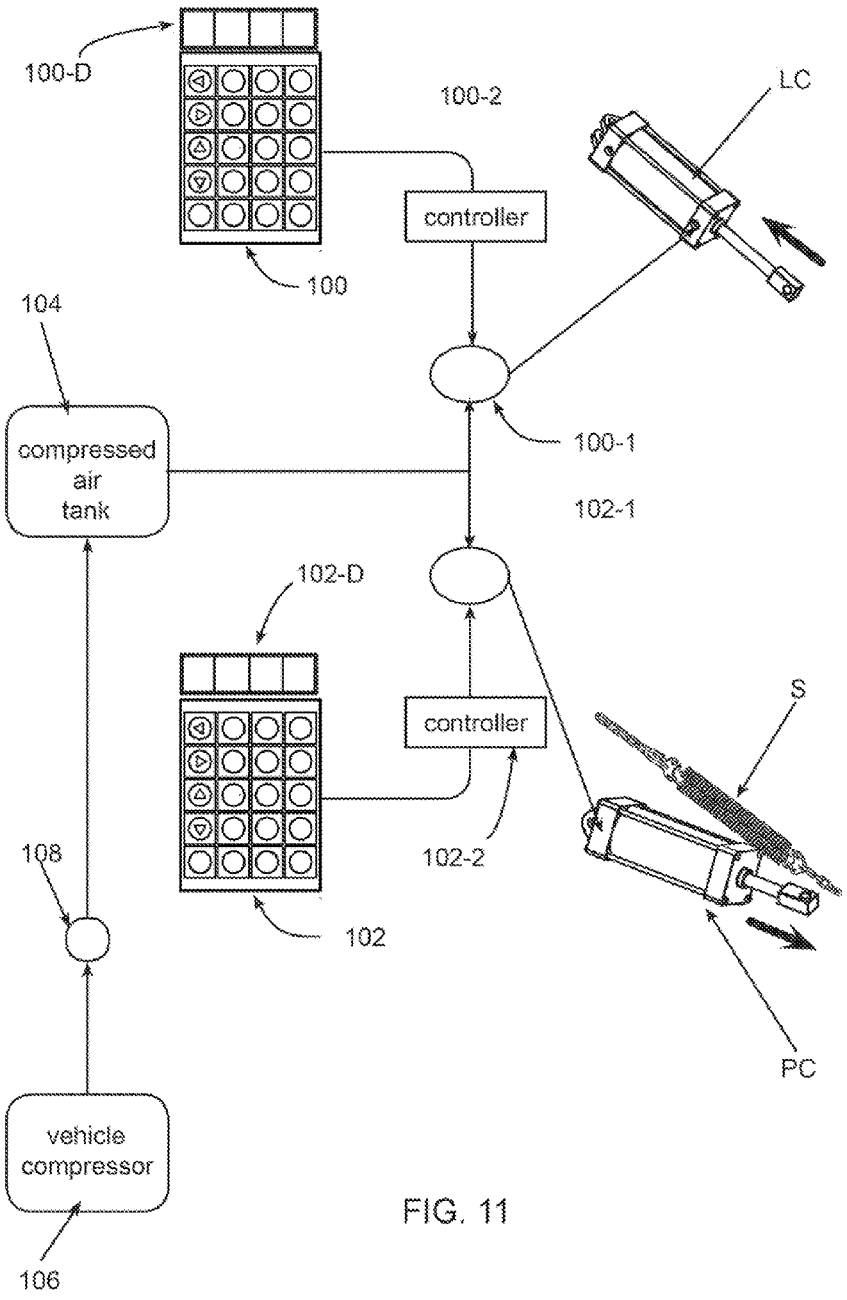
FIG. 11 is a schematic control diagram showing one way in which the pneumatic cylinders can be controlled.

A basic and representative system for controlling the lift cylinder LC and the position-control cylinder PC is shown in simplified schematic form in FIG. 11. As shown, a keypad 100 is provided to accept operator-input for the position-control cylinder PC and another keypad 102 is provided to accept operator-input for the lift cylinder LC; both keypads can include respective numeric or alphanumeric displays 100-D and 102-D. The outputs of the keypads are provided to respective controllers 100-2 and 102-2 which, in turn, provide control signals to digital air-pressure regulators 100-1 and 102-1. The digital air-pressure regulators 100-1 and 102-1 provide pressurized air at the selected air pressure value to the rod end of the lift cylinder LC and to the position-control cylinder PC to control the 'lift' or the sweeping force of the gutter broom 12 and the swing-out position of the gutter broom 12. Air pressure for the digital air-pressure regulators 100-1 and 102-1 is provided from a compressed air tank 104 which is filled with pressurized air via a regulator 108 that regulates air pressure from a vehicle engine-driven air compressor 106.

The controllers can take the form of stored-program controlled (i.e., firmware and/or software) microprocessors or microcomputers (as well as special-purpose processors, including RISC processors), application specific integrated circuits (ASIC), programmable logic arrays (PLA), discrete logic or analog circuits or combinations thereof, with related non-volatile and volatile memory, and/or combinations thereof.

A suitable program-controlled air pressure regulator that is compatible with DeviceNet or Profibus controllers is available from ControlAir, Inc. of Amhearst, N.H. under the T5500 model designation.

If desired, the system of FIG. 11 can be integrated into a touch-screen arrangement that both displays the operating state of the gutter brush and accept inputs from the vehicle operator.

As will be apparent to those skilled in the art, various changes and modifications may be made to the illustrated embodiment without departing from the spirit and scope of the invention as determined by the appended claims and their legal equivalent.

The invention claimed is:

1. In a roadway or pavement sweeper vehicle of the type having at least one gutter broom assembly moveable from a retracted position to and from an extended position relative to a side of the vehicle, a system for positioning the gutter broom at a selected one of a plurality of positions intermediate the retracted position and the extended position, comprising:

a pneumatic cylinder connected to the gutter broom assembly and a support structure, the gutter broom assembly movably mounted on the support structure for movement relative to the support structure under control of the pneumatic cylinder to a selected one of a plurality of lateral positions intermediate a retracted position and an extended position in response to the introduction of pressurized air at a selected one of a plurality of air pressure values into the pneumatic cylinder; and means for providing a resilient spring force for resisting the extension of the pneumatic cylinder in response to the introduction of pressurized air thereinto, the pneumatic cylinder and the means for providing a resilient spring force attaining a equilibrium position corresponding to the selected one of the plurality of air pressure values and the selected one of the plurality of lateral positions intermediate a retracted position and an extended position.

2. The sweeper vehicle of claim 1, further comprising:

the pneumatic cylinder has a rod-end and a cylinder-end, the rod-end connected to the gutter broom assembly and the cylinder-end thereof connected to the support.

3. The sweeper vehicle of claim 2, further comprising:

the rod end of the pneumatic cylinder is connected to the gutter broom assembly via a spherical rod end.

4. The sweeper vehicle of claim 1, wherein:

a controller organization for providing pressured air to said pneumatic cylinder at a selected air pressure to position the gutter broom assembly at a selected lateral position.

5. The sweeper vehicle of claim 1, wherein the means for providing a resilient spring force further comprises:

at least one helical spring that extends in response to the introduction of pressurized air into the pneumatic cylinder, the pneumatic cylinder and at least one spring attaining a equilibrium position corresponding a selected air pressure value.

6. The sweeper vehicle of claim 5, wherein the means for providing a resilient spring force further comprises:

a first and a second helical coil spring connected in parallel with one another to define a spring assembly, the spring assembly extending in response to the introduction of pressurized air into the pneumatic cylinder, the pneumatic cylinder and spring assembly attaining a equilibrium position corresponding a selected air pressure value.

7. The sweeper vehicle of claim 1, further comprising:

a second pneumatic cylinder connected to the gutter broom assembly for lifting the gutter groom assembly from a lowered position in which the gutter broom contacts the surface of the roadway to an upper elevated position.

8. The sweeper vehicle of claim 1, wherein the means for providing a resilient spring force further comprises:

at least one helical spring associated with the pneumatic cylinder for resisting the extension thereof in response to the introduction of pressurized air into the pneumatic cylinder.

9. In a roadway or pavement sweeper vehicle of the type having at least one gutter broom assembly mounted on a support for pivotal movement relative to the support from a retracted position to an extended position relative to a side of the vehicle, a method for positioning the gutter broom at a selected one of a plurality of positions intermediate the retracted position and the extended position, comprising the steps of:

providing a pneumatic cylinder connected to the gutter broom assembly, the gutter broom assembly movably mounted on a support for movement relative to the support under control of the pneumatic cylinder to a selected lateral position intermediate a retracted position and an extended position in response to the introduction of pressurized air at a selected air pressure value into the pneumatic cylinder; and providing a resilient spring force between the gutter broom assembly and the support for resisting the extension of the pneumatic cylinder in response to the introduction of pressurized air thereinto, the pneumatic cylinder and spring element attaining a equilibrium position corresponding the selected air pressure value and a selected one of a plurality of lateral positions intermediate the retracted position and the extended position.

* * * * *